United States Patent [19]

Farge et al.

[11] 4,338,128

[45] Jul. 6, 1982

[54] LOW ALLOY WHITE CAST IRON

[75] Inventors: Jean C. Farge, Montreal; Robert Fortin, Mont Joli, both of Canada

[73] Assignee: Noranda Mines Limited, Toronto, Canada

[21] Appl. No.: 138,752

[22] Filed: Apr. 9, 1980

[30] Foreign Application Priority Data

Jun. 13, 1979 [CA] Canada ..... 329649

[51] Int. Cl.[3] ..... C22C 33/00

[52] U.S. Cl. ..... 75/123 CB; 75/123 K; 75/123 L; 148/35

[58] Field of Search ..... 75/123 CB, 123 K, 123 L; 148/35

[56] References Cited

U.S. PATENT DOCUMENTS 3,909,252 9/1975 Kuriyama et al. ..... 75/123 CB 3,951,650 4/1976 Miyashita ..... 75/123 CB

OTHER PUBLICATIONS

Engineering Properties and Applications of Ni-Hard, 1978, The International Nickel Co., Inc.

A Dictionary of Metallurgy, A. D. Merriman, pp. 293-294.

*Primary Examiner*—John P. Sheehan

*Attorney, Agent, or Firm*—Fleit & Jacobson

[57] ABSTRACT

A low alloy white cast iron is disclosed. The alloy consists essentially, in weight percent, of about 2.5 to 4% carbon, 0.3 to 0.8% silicon, 0.3 to 1.0% manganese, and 1.7 to 3.5% nickel, the rest being iron except for incidental impurities commonly found in cast iron. The alloy has a microstructure consisting essentially of martensite and carbide and a minimum hardness of 600 B.H.N.

2 Claims, No Drawings

LOW ALLOY WHITE CAST IRON

This invention relates to a low alloy white cast iron having a high hardness and a microstructure consisting essentially of martensite and carbide. Its main application is expected to be in the manufacture of grinding balls and slugs for the ore processing industry.

The selection of grinding balls is based primarily on cost-to-wear ratio. Mill superintendents are always interested in decreasing the cost of grinding and will, therefore, purchase the alloy which will give them the lowest price of grinding material per ton of ground ore. The choice of ball composition is extremely important because it has a direct effect on the performance of the balls. Specific consumption of grinding balls depends primarily on microstructure and, to some extent, on variations in hardness of the ore and fineness to which it is ground. The microstructure of grinding balls is controlled by their chemical analysis and by the processing conditions to which they are subjected during manufacture.

Because of its outstanding abrasion resistance, a nickel-chromium white cast iron known as Ni-Hard has been successfully used for over forty years to make grinding balls. The alloy is described in a brochure entitled "Engineering Properties and Applications of Ni-Hard" 1978, published by The International Nickel Company Inc. The microstructure of Ni-Hard consists primarily of martensite and carbide. Its minimum hardness is 500 B.H.N. in the sand cast and stress relieved condition and 600 B.H.N. in the chill cast and stress relieved condition. Compositional ranges suggested for the manufacture of Ni-Hard grinding balls and slugs are about 3% carbon. 0.5% silicon, 0.5% manganese, 1.5–4% nickel and 1.0–2% chromium, the rest being iron.

Because of increased cost of alloying and potential shortage of elements such as chromium, a research program was initiated by the Assignee of the present application to try and develop a white cast iron which would have similar characteristics to those of Ni-hard but which would contain less alloying constituents.

Such research program has surprisingly lead the applicant to the discovery of a new low alloy white cast iron containing essentially 2.5 to 4% carbon, 0.3 to 0.8% silicon, 0.3 to 1% manganese, and 1.7 to 3.5% nickel, the rest being iron except for incidental impurities commonly found in cast iron. The alloy microstructure consists essentially of martensite and carbide and its minimum hardness is 600 B.H.N. The preferred alloy composition consists essentially of about 2.5 to 3.5% carbon, about 0.6% silicon, about 0.7% manganese, and about 1.7 to 3% nickel, the rest being substantially iron except for incidental impurities commonly found in cast iron.

The process for manufacturing the above white cast iron comprises the steps of melting the metal charge in a suitable furnace, casting it into moulds to produce a product such as grinding balls or slugs, shaking the product out of the moulds at a temperature above the transformation temperature and cooling it between approximately 1400° F. and 400° F. at a minimum rate of 2.5° F./sec. The product is preferably heat treated at a temperature of 400° to 600° F., a preferably about 500° F. for a time period of 4 to 8 hours, preferably 4 hours to transform retained austenite into martensite and to relieve casting stresses.

Before arriving at the preferred embodiment, a test programm on white cast irons containing 2.0 to 4% carbon, 0.25 to 1.25% silicon, 0.25 to 1.5% manganese, 1.0 to 4% nickel and 0 to 2.5% chromium was carried out on a pilot scale. It was found that nickel had a strong effect on the as-cast microstructure of the various white cast irons. When the nickel content was below 1.7%, pearlite appeared in the microstructure and above 3.5% nickel, large amounts of retained austenite were present. It is well known that the formation of substantial amounts of pearlite and retained austenite reduces the overall hardness of white cast iron. It was also surprisingly found that chromium was not an essential element, as one may have been lead to believe from the description of Ni-Hard, and that a nickel bearing white cast iron having a high hardness and a microstructure consisting essentially of martensite and carbide can be made without the presence of chromium as an alloying element. The amount of carbide in the microstructure was controlled by the carbon content; the higher the carbon, the more carbide being formed. In agreement with good melting and casting practice for the manufacture of white cast irons, it was found that silicon should be kept in the range of 0.4–0.8% and manganese in the range of 0.5–0.9%. The total amount of carbon and silicon should also be kept low enough to avoid the formation of graphite flakes which is detrimental to hardness of low alloy white cast iron. The manganese content is also maintained low to avoid damage to the refractory of the furnace used to melt the alloy. In the above description, the alloy compositions were given in weight percent.

An example of the procedure followed in the test programm will now be disclosed. Metal charges consisted of pig iron, steel scrap, ferro-maganese, ferro-silicon, nickel and ferro-chrome. The charges were melted in a coreless induction furnace and poured into moulds containing either ½ of 3 in. slug cavities. The slugs were shaken out of the moulds at a temperature above the transformation temperature and were either cooled with fine water sprays or subjected to forced air or still air cooling. The corresponding cooling rates were established using thermocouples inserted into the slug cavities, while the metal was still molten and connected to a recording instrument. Recording of the temperature was started from approximately 1650° F. Best results were obtained with a minimum cooling rate of 2.5° F./sec. Slower rates resulted in pearlite being formed in the microstructure particularly when the nickel content was low. The following Table I gives the relationship between alloy additions, hardness and microstructure for ½ and 3 in. slugs subjected to water sprays cooling from above the transformation temperature.

TABLE I

PROPERTIES OF AS-CAST, 1½ AND 3 IN. WHITE CAST IRON SLUGS CONTAINING 3% C, 0.6% Si AND 0.7% Mn

| SLUG SIZE in. | ALLOY ADDITIONS (%) Ni | Cr | AVERAGE HARDNESS B.H.N. | MICROSTRUCTURE+ |
|---|---|---|---|---|
| 1½ | 1.13 | 1.09 | 595 | C + P |
| 1½ | 1.50 | — | 510 | C + P |
| 1½ | 1.55 | 0.86 | 575 | C + RA + M + P |
| 1½* | 1.70 | — | 640 | C + RA + M |
| 1½ | 1.90 | 1.38 | 575 | C + RA + M |
| 1½ | 2.40 | — | 645 | C + RA + M |
| 3 | 2.70 | — | 605 | C + RA + M |
| 3 | 2.95 | — | 625 | C + M + RA |

TABLE I-continued

PROPERTIES OF AS-CAST, 1½ AND 3 IN. WHITE CAST IRON SLUGS CONTAINING 3% C, 0.6% Si AND 0.7% Mn

| SLUG SIZE | ALLOY ADDITIONS (%) | | AVERAGE HARDNESS | MICROSTRUCTURE+ |
|---|---|---|---|---|
| in. | Ni | Cr | B.H.N. | |
| 3 | 3.70 | 1.2 | 455 | C + RA + M |

*Part of a 3-ton production lot cast at Norcast Ltd. under conditions similar to those used in the pilot scale tests.
+C - Carbide
P - Pearlite
RA - Retained austenite
M - Martensite As-cast slugs containing retained austenite in addition to carbide and martensite were subjected to a heat treatment of 4 to 8 hours at 400°-600° F. Best results were obtained with a treatment of 4 hours at 500° F. as shown in the following Table II:

TABLE II

PROPERTIES OF 1½ AND 3 IN. WHITE CAST IRON SLUGS CONTAINING 3% C, 0.6% Si AND 0.7% Mn, AND SUBJECTED TO A HEAT TREATMENT OF FOUR HOURS AT 500° F.

| SLUG SIZE | ALLOY ADDITIONS (%) | | AVERAGE HARDNESS | MICROSTRUCTURE+ |
|---|---|---|---|---|
| in. | Ni | Cr | B.H.N. | |
| 1½ | 1.90 | 1.38 | 635 | C + M* |
| 1½ | 1.92 | — | 660 | C + M* |
| 3 | 2.70 | — | 645 | C + M* |
| 3 | 2.95 | — | 660 | C + M* |

C - Carbide
M* - Complex phase consisting of tempered martensite, retained austenite, bainite and fresh martensite.

The following observations can be made from the above results:

(a) Nickel in concentrations higher than 1.7% produces a microstructure consisting essentially of carbide, retained austenite and martensite which is a characteristic of a white cast iron having a high hardness. When the nickel content was below 1.7%, pearlite appeared in the microstructure. When the nickel content was above 3.5%, large amounts of retained austenite were present.

(b) Chromium is not an essential alloying element. A nickel bearing white cast iron having substantially the same hardness and a microstructure consisting essentially of carbide, retained austenite and martensite has been obtained without the presence of chromium.

(c) The hardness of the alloy has been slightly increased by heat treatment.

Full scale foundry tests have shown that the new white cast iron of the present invention may be melted and cast using ordinary foundry practice and casting methods. The melting equipment used so far in these full scale tests has been a channel-type induction furnace. However, other melting equipments such as cupolas or various types of electric furnaces could also be used. Tests to date have been made on ½ inch grinding slugs cast in permanent moulds. Sand casting could also be used provided that the products are shaken out of the mould at a temperature above the transformation temperature.

Although the invention has been disclosed with reference to a preferred example, it is to be understood that other alloy compositions are also envisaged within the broad range disclosed and that the various steps for making the alloy including the cooling rates from various shake out temperature and the temperature of the heat treatment may be varied within the limits defined in the accompanying claims.

The embodiments of the invention in which an exclusive property or privilege is claimed are defined as follows:

1. A low alloy white cast iron consisting, in weight percent, of about 2.5 to 4% carbon, 0.3 to 0.8% silicon, 0.3 to 1.0% manganese and 1.7 to 3.5% nickel, the rest being iron except for incidental impurities commonly found in cast iron, said alloy having a microstructure consisting essentially of martensite and carbide and a minimum hardness of 600 B.H.N.

2. A low alloy white cast iron as defined in claim 1, wherein the composition of the alloy consists of about 2.5 to 3.5% carbon, about 0.6% silicon, about 0.7% manganese and about 1.7 to 3.0% nickel, the rest being iron except for incidental impurities commonly found in cast iron.

* * * * *